US007832440B2

(12) United States Patent
Richardson et al.

(10) Patent No.: US 7,832,440 B2
(45) Date of Patent: Nov. 16, 2010

(54) MACHINE AND METHOD FOR APPLYING PRESSURE SENSITIVE SAMPLE CHIPS TO A CARD

(75) Inventors: Joseph T. Richardson, Irvine, CA (US); Brian Andrew Bruning, Carmel, IN (US); James J. Schutte, Greensburg, IN (US)

(73) Assignee: Masco Corporation, Taylor, MI (US)

( * ) Notice: Subject to any disclaimer, the term of this patent is extended or adjusted under 35 U.S.C. 154(b) by 929 days.

(21) Appl. No.: 11/653,527

(22) Filed: Jan. 15, 2007

(65) Prior Publication Data

US 2008/0169054 A1 Jul. 17, 2008

(51) Int. Cl.

| | |
|---|---|
| ***G05G 15/00*** | (2006.01) |
| ***B29C 65/78*** | (2006.01) |
| ***B29C 65/48*** | (2006.01) |
| ***B32B 37/10*** | (2006.01) |
| ***B32B 37/12*** | (2006.01) |
| ***B32B 41/00*** | (2006.01) |
| ***B32B 37/26*** | (2006.01) |
| ***B65C 9/26*** | (2006.01) |
| ***B65C 9/40*** | (2006.01) |

(52) U.S. Cl. ..... 156/350; 156/362; 156/364; 156/391; 156/580; 156/537

(58) Field of Classification Search ..... 156/249, 156/277, 289, 310, 350, 351, 362, 364, 391, 156/537, 580, 582

See application file for complete search history.

(56) References Cited

U.S. PATENT DOCUMENTS

| | | | | |
|---|---|---|---|---|
| 3,793,114 | A * | 2/1974 | Thomas | 156/361 |
| 4,061,521 | A | 12/1977 | Lerner et al. | |
| 4,104,809 | A | 8/1978 | Day et al. | |
| 4,267,004 | A * | 5/1981 | Anderson | 156/361 |
| 4,457,718 | A | 7/1984 | Lerner | |
| 5,313,884 | A | 5/1994 | Lerner et al. | |
| 5,387,302 | A * | 2/1995 | Bernard et al. | 156/352 |
| 5,622,594 | A | 4/1997 | Lerner et al. | |
| 6,030,481 | A | 2/2000 | Winter et al. | |
| 6,086,694 | A * | 7/2000 | Winter et al. | 156/64 |
| 6,416,612 | B1 | 7/2002 | Lerner et al. | |
| 6,558,490 | B2 | 5/2003 | Klein et al. | |

(Continued)

FOREIGN PATENT DOCUMENTS

GB 1386888 A * 3/1975

*Primary Examiner*—Philip C Tucker
*Assistant Examiner*—Sing P Chan
(74) *Attorney, Agent, or Firm*—Reising Ethington PC

(57) ABSTRACT

A machine for applying pressure sensitive sample chips to a card includes a linear conveyor for receiving and transporting cards, and at least one sample application station disposed along the conveyor. The sample application station includes a feed roller overlying and spaced from the conveyor for holding a spool containing at least one row of individual pressure sensitive sample chips on a substrate. A plate has an edge immediately overlying and spaced from the conveyor to permit passage of cards beneath the edge. A drive roller is spaced from the feed roller and from the plate for drawing the substrate from the spool on the feed roller over the plate edge to separate the sample chips from the substrate and apply the chips to the cards. A resilient roller preferably is disposed adjacent to the plate edge for pressing the sample chips removed from the substrate onto the cards transported on the conveyor.

5 Claims, 4 Drawing Sheets

U.S. PATENT DOCUMENTS 6,884,312 B2 4/2005 Mitchell et al.
7,005,171 B2 2/2006 Lerner et al.
7,007,601 B2 3/2006 Winter et al.
2007/0056675 A1* 3/2007 Lerner et al. ..... 156/64

* cited by examiner

MACHINE AND METHOD FOR APPLYING PRESSURE SENSITIVE SAMPLE CHIPS TO A CARD

The present disclosure relates to application of sample chips to a card, such as paint color chips to a preprinted display card, and more particularly to a machine and method for automated application of pressure sensitive sample chips to preprinted cards in sequence.

BACKGROUND AND SUMMARY OF THE DISCLOSURE

It has been proposed to apply individual sample chips of paint, for example, to a card or the like for customer viewing and selection of a desired color. Sample application techniques proposed in the prior art generally are characterized by a high machine maintenance cost and an excessive scrap rate, sometimes approaching 10 to 15%. It is a general object of the present disclosure to provide a machine and a method for applying pressure sensitive sample chips to a card that is characterized by a reduced maintenance cost and/or a reduced scrap rate.

The present disclosure embodies a number of aspects that can be implemented separately from or in combination with each other.

A machine for applying pressure sensitive sample chips to a card, in accordance with one aspect of the present disclosure, includes a linear conveyor for receiving and transporting cards, and at least one sample application station disposed along the conveyor. The sample application station includes a feed roller overlying and spaced from the conveyor for holding a spool containing at least one row of individual pressure sensitive sample chips on a substrate. A plate has an edge immediately overlying and spaced from the conveyor to permit passage of cards beneath the edge. A drive roller is spaced from the feed roller and from the plate for drawing the substrate from the spool on the feed roller over the plate edge to separate the sample chips from the substrate and apply the chips to the cards. A resilient roller preferably is disposed adjacent to the plate edge for pressing the sample chips removed from the substrate onto the cards transported on the conveyor. There preferably are a plurality of such sample application stations disposed in series along the conveyor, with each station operating intermittently to apply a column of sample chips to the cards, which preferably have preprinted indicia for coordination with the sample chips applied immediately adjacent to the indicia.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
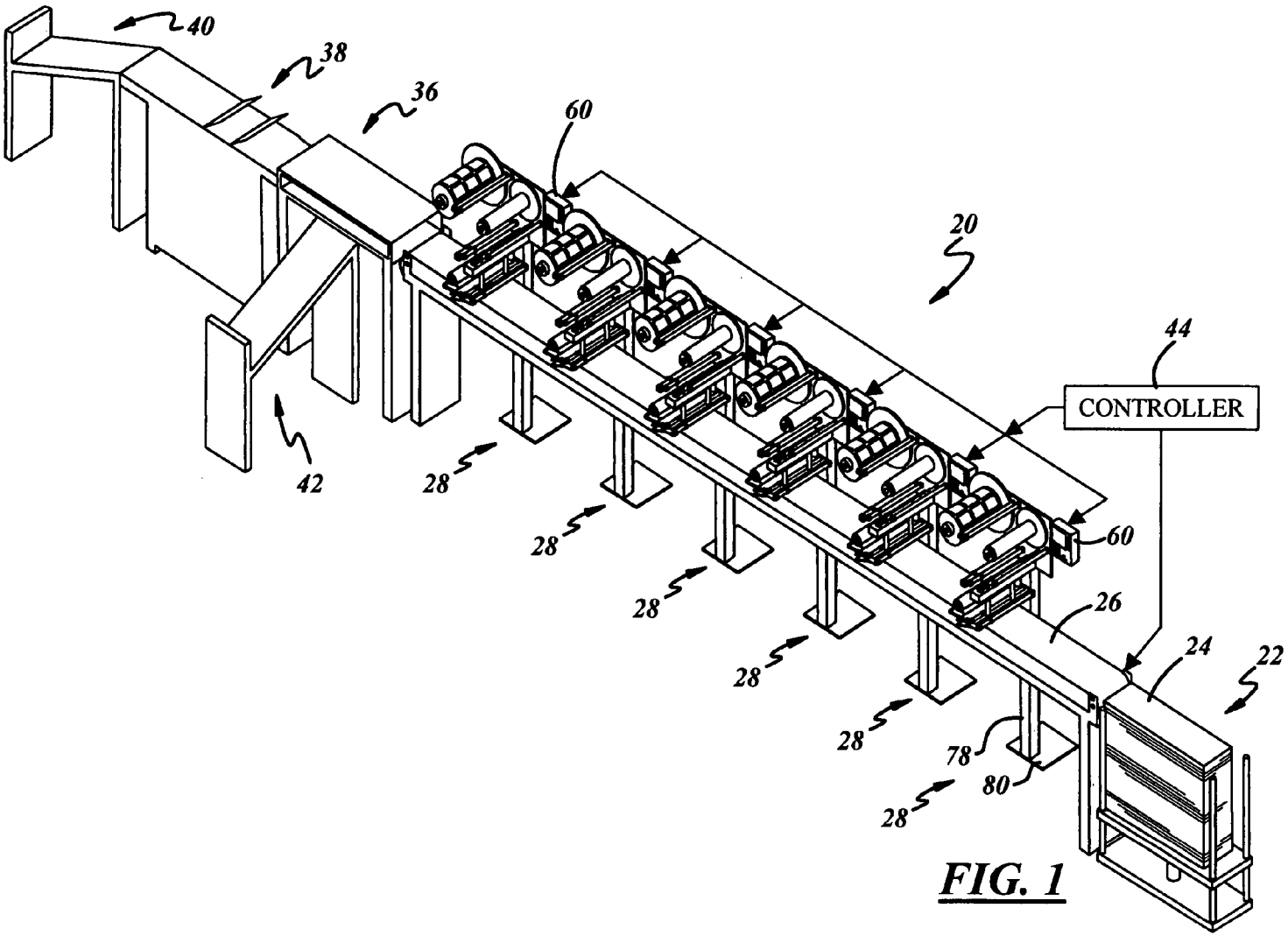
FIG. 1 is a perspective schematic illustration of a machine for applying pressure sensitive sample chips to a series of preprinted blanks in accordance with an exemplary embodiment of the present disclosure.
Figure 2:
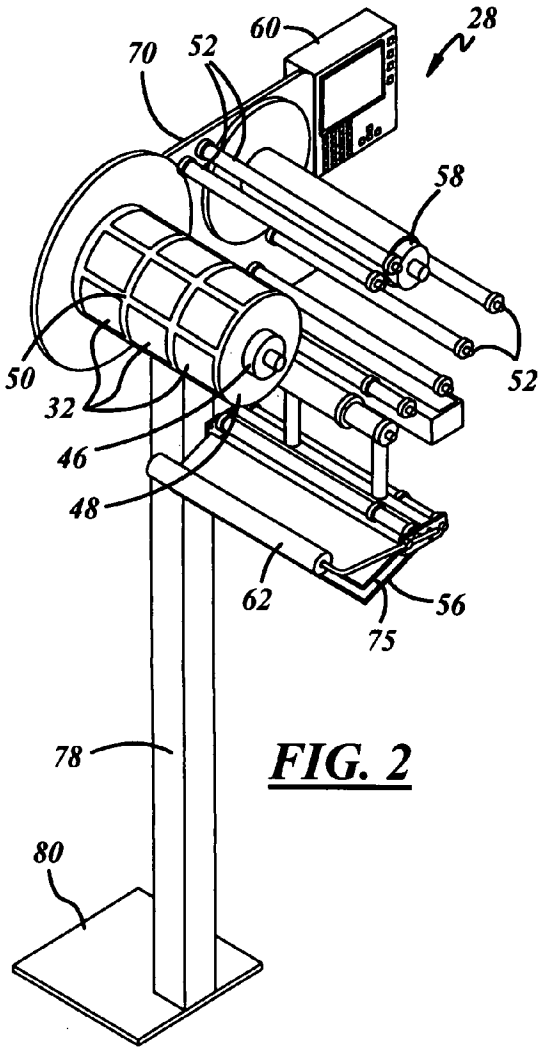
FIG. 2 is a perspective view of one of the sample application stations in the machine of FIG. 1.

FIG. 1 illustrates a machine 20 for applying pressure sensitive sample chips to blank cards in accordance with an exemplary embodiment of the present disclosure. Machine 20 includes a hopper 22 for feeding individual cards 24 in sequence to a linear conveyor 26. Conveyor 26 transports cards 24 in sequence through at least one sample application station 28, and preferably a plurality of sample application stations 28 disposed in series along the length of conveyor 26. Sample application stations 28 preferably are identical in construction. Each station 28 applies a column 30 (FIG. 6) of sample chips 32 to card 24, which preferably is preprinted with indicia 76 that is coordinated with the positions of the applied chips 32 to identify the individual chips. The several stations 28, operating in sequence, apply a plurality of rows 34. Returning to FIG. 1, cards 24 with sample chips 32 applied thereto preferably are fed in sequence to an inspection station 36 and then through a fold stations 38 to a collection station 40. Any cards rejected at inspection station 36 are fed to a reject station 42. Sample application stations 28 are connected to a central controller 44, which also is connected to conveyor 28 to operate the conveyor continuously to transport cards 24 in sequence through the machine.

Figure 3:
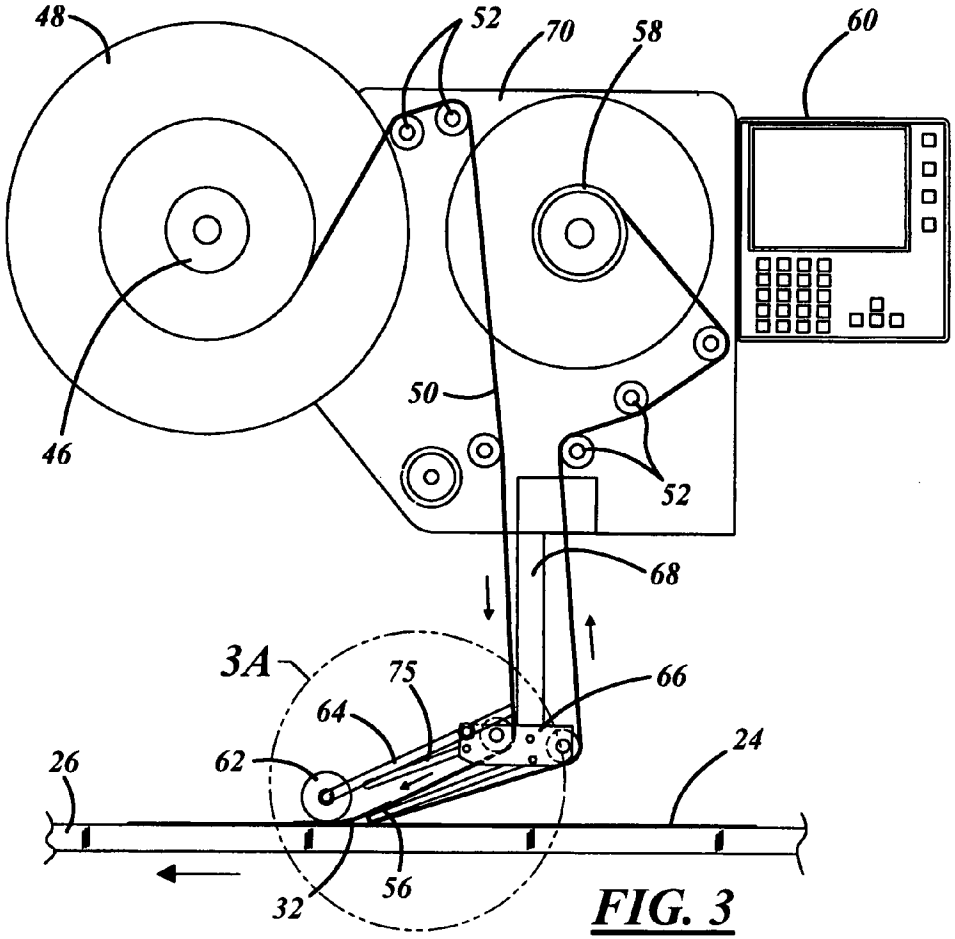
FIG. 3 is a fragmentary elevational view of a sample application station applying pressure sensitive chips in the machine of FIG. 1.
Figure 3A:
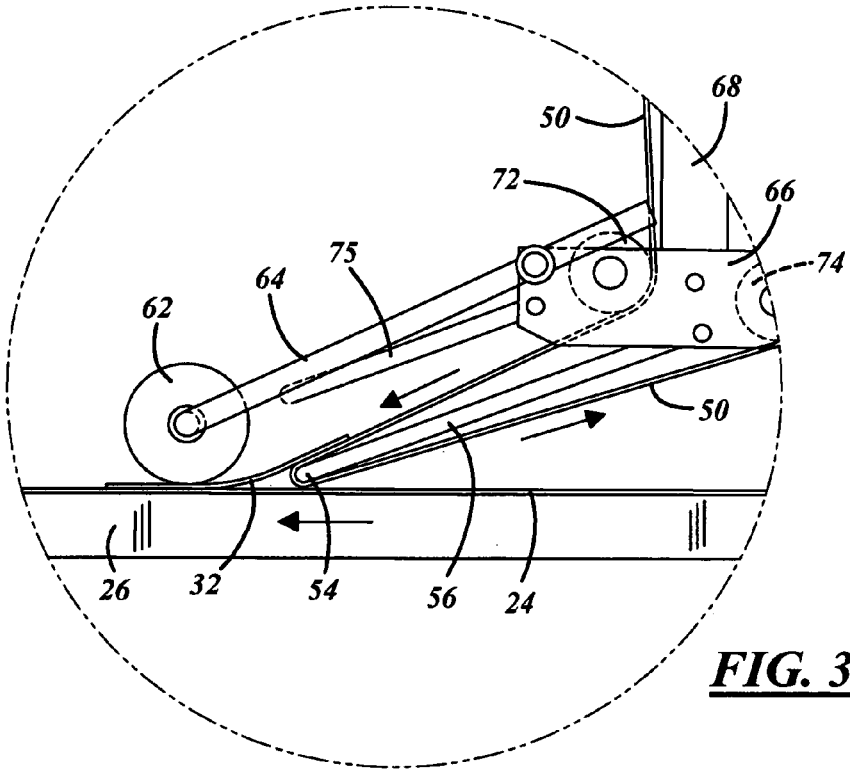
FIG. 3A is an enlarged view of the portion of FIG. 3 within the area 3A in operation.
Figure 4:
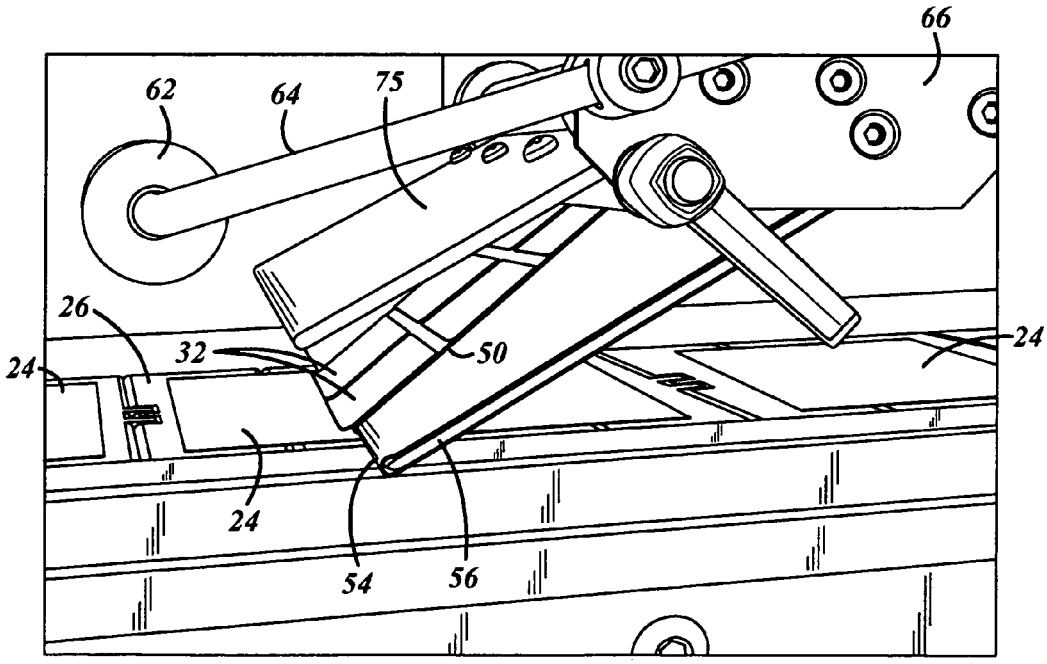
FIG. 4 is a fragmentary perspective view of the sample application station in FIGS. 3 and 3A in operation.
Figure 5:
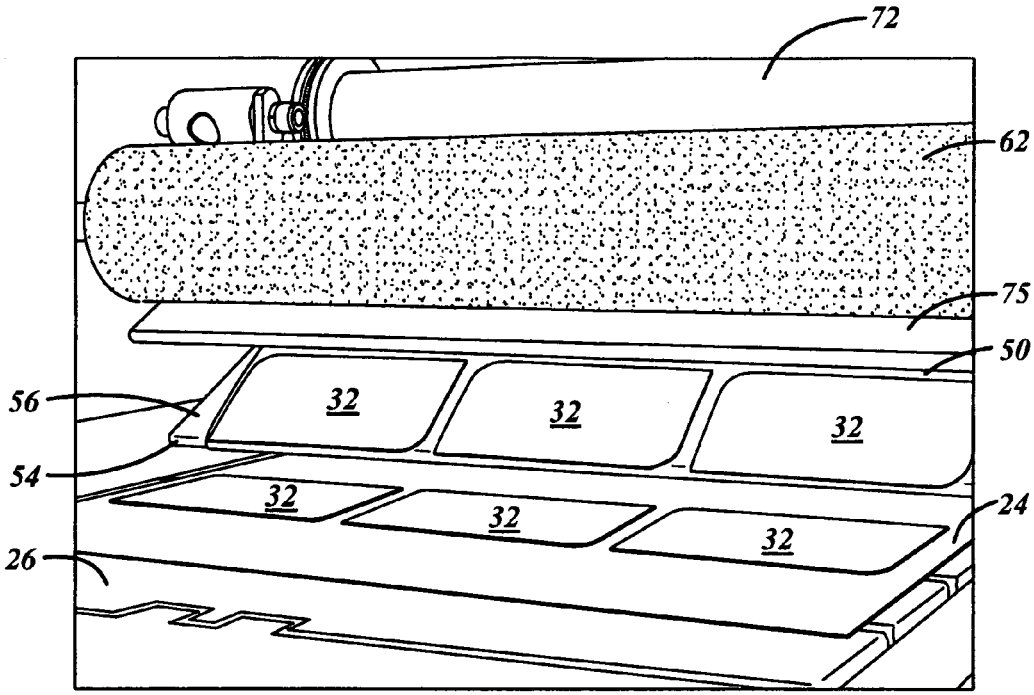
FIG. 5 is a perspective view of the sample application station in FIG. 4.

FIGS. 2-5 illustrate one of the sample application stations 28. A feed roller 46 overlies and is spaced from conveyor 26, and is adapted to hold a spool 48 containing at least one row of individual pressure sensitive sample chips 32 on a substrate 48. Three rows of sample chips 32 are shown in FIGS. 2-5 for purposes of illustration. Substrate 50 is a continuous sheet that is trained from spool 48 around posts 52 as required, and then around the edge 54 of a plate 56. Plate 56 is at an acute angle to the upper surface of conveyor 26. Plate edge 54 immediately overlies conveyor 26 and is spaced from the surface of the conveyor to permit passage of cards 24 beneath the plate edge. After encircling plate edge 54, substrate 50 is trained around further posts 52 as needed and then onto a drive roller 58. Drive roller 58 is spaced from feed roller 46 and from plate 56. Drive roller 58 is operated and powered by a controller 60 to draw substrate 50 having pressure sensitive sample chips 32 thereon around the sharp edge 54 of plate 56 and then to roller 58. A pair of rollers 72, 74 preferably are carried by a plate 66 immediately upstream and downstream of plate edge 54 (with respect to the direction of motion of substrate 50) so that substrate 50 is taut and essentially reverses direction as it travels over edge 54. Substrate 50 is drawn over plate edge 54 in a direction opposite to the direction of travel of conveyor 26, as best seen in FIG. 3A. As substrate 50 is drawn around edge 54, pressure sensitive sample chips 32 automatically separate themselves from substrate 50 for deposition onto cards 24.

A resilient roller 62 is mounted on an arm 64 that is carried by plate 66, which is suspended by an arm 68 from the support 70 on which rollers 46, 58 and controller 60 are mounted. Plate 66 preferably carries spaced rollers 72, 74 around which substrate 50 is trained before and after passage around plate edge 54. Roller 62 preferably is held by arm 64 in engagement with conveyor 26 so as to press pressure sensitive sample chips 32, which separate themselves from substrate 50, onto cards 24 in sequence. Arm 64 and roller 62 preferably can be lifted to an elevated position illustrated in FIG. 4 for purposes of set-up and maintenance of the machine. A second plate 75 may be mounted on plate 66 overlying plate 56 to cover substrate 50 as it is drawn around plate 56. Spools 48 can be formed in any suitable manner. For example, sample ribbons can be formed on a pressure sensitive substrate. The pressure sensitive ribbons can be applied to substrate 50, and the sample/pressure sensitive substrate then die cut into separate sample chips 32 on substrate 50.

Figure 6:
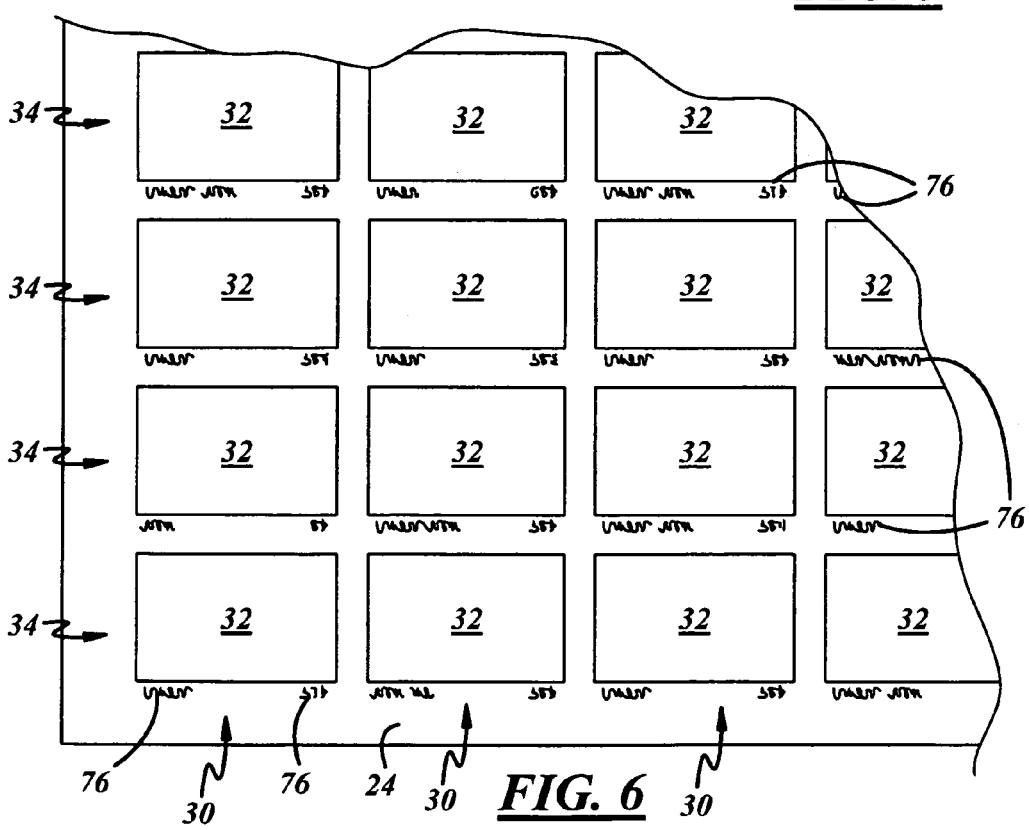
FIG. 6 is a fragmentary plan view of a sample card or sheet made with the machine of FIGS. 1-5.

The several controls 60 of stations 28 are connected to machine controller 44 as illustrated in FIG. 1. The several sample application stations 28 preferably are operated intermittently so that each station 28 applies one column 30 of sample chips 32, and the several stations in sequence apply rows 34 of sample chips as illustrated in FIG. 6. As previously indicated, card 24 preferably is provided with preprinted indicia 76 for identifying and distinguishing among the several sample chips 32. The support 70 of each sample application station 28 is mounted on a leg 78 that has a base 80 for supporting station 28 on the floor, for example. Thus, the several stations 28 can be disconnected from controller 28 and moved away from conveyor 26 for maintenance or repair, for example, while being replaced by a new station 28. The several stations 28 preferably are identical except for the spools 48, which will be different for each station.

There thus have been disclosed a machine and method for applying pressure sensitive sample chips to a card, which fully achieve all of the objects and aims previously set forth. The disclosure has been presented in conjunction with a presently preferred embodiment, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A machine for applying pressure sensitive sample chips to a card, which includes:

a linear conveyor for receiving and transporting cards, and at least one sample application station disposed along said conveyor, said sample application station including:

a feed roller overlying and spaced from said conveyor for holding a spool containing at least one row of individual pressure sensitive sample chips on a substrate, a first plate having an edge immediately overlying and spaced from said conveyor to permit passage of cards beneath said edge, a drive roller spaced from said feed roller and said first plate for drawing the substrate from the spool on said feed roller over said edge to separate the pressure sensitive sample chips from the substrate and apply the chips to the cards, and a resilient roller adjacent to said edge for pressing pressure sensitive sample chips removed from the substrate onto cards transported on said conveyor, wherein said first plate is suspended from a second plate, and said resilient roller is mounted to said second plate by a pivot arm that is pivotal with respect to said first plate and said second plate such that said pivot arm and said roller can be pivoted away from said edge and said conveyor to an elevated position for set-up and maintenance of said machine.

2. The machine set forth in claim 1 wherein said first plate is at an acute angle to a surface of said conveyor.

3. The machine set forth in claim 2 wherein said sample application station includes a control for operating said drive roller intermittently.

4. The machine set forth in claim 3 wherein said feed roller, said first plate, said resilient roller, said drive roller and said control are all mounted on a movable base that is separate from said conveyor.

5. The machine set forth in claim 1 including a plurality of said sample application stations spaced from each other lengthwise of said conveyor, each of said stations being operable to apply a column of pressure sensitive sample chips to a card in sequence as the card is transported past said stations by said conveyor.

* * * * *